US008894254B2

(12) United States Patent
Matsuda et al.

(10) Patent No.: US 8,894,254 B2
(45) Date of Patent: Nov. 25, 2014

(54) LUMINAIRE AND LAMP APPARATUS HOUSING

(75) Inventors: Ryotaro Matsuda, Yokosuka (JP); Jun Sasaki, Yokosuka (JP); Shigeru Osawa, Yokosuka (JP); Yuichiro Takahara, Yokosuka (JP); Hiromichi Nakajima, Yokosuka (JP); Kenji Takanashi, Yokosuka (JP); Keiichi Shimizu, Yokosuka (JP); Masahiro Izumi, Yokosuka (JP); Hiroshi Matsushita, Yokosuka (JP); Masahiro Toda, Yokosuka (JP); Junichi Kimiya, Yokosuka (JP); Hiroshi Takenaga, Yokosuka (JP); Takeshi Osada, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 164 days.

(21) Appl. No.: 13/361,791

(22) Filed: Jan. 30, 2012

(65) Prior Publication Data

US 2012/0262928 A1 Oct. 18, 2012

(30) Foreign Application Priority Data

Jan. 31, 2011 (JP) ..... 2011-019005
Jan. 31, 2011 (JP) ..... 2011-019006
Mar. 31, 2011 (JP) ..... 2011-079079

(51) Int. Cl.
*F21V 29/00* (2006.01)
*F21V 15/01* (2006.01)

(Continued)

(52) U.S. Cl.
CPC ..... *F21V 17/002* (2013.01); *F21V 7/09* (2013.01); *F21V 15/01* (2013.01); *F21V 29/004* (2013.01); *F21K 9/30* (2013.01); *F21V 23/006* (2013.01); *F21V 29/24* (2013.01); *F21V 23/009* (2013.01); *F21V 29/2231* (2013.01); *F21V 3/02* (2013.01); *F21S 8/026* (2013.01); *F21Y 2101/02* (2013.01); *F21V 29/262* (2013.01)
USPC ..... 362/373; 362/365; 362/374; 362/294; 362/249.02

(58) Field of Classification Search
USPC ..... 362/373, 383, 374, 294
See application file for complete search history.

(56) References Cited

U.S. PATENT DOCUMENTS

2008/0037255 A1* 2/2008 Wang ..... 362/294
2009/0097262 A1* 4/2009 Zhang et al. ..... 362/364

(Continued)

FOREIGN PATENT DOCUMENTS

EP 2 455 651 A2 5/2012
EP 2 455 655 A2 5/2012

(Continued)

OTHER PUBLICATIONS

Machine English translation of JP 2010-147000 to Yokoya.*

(Continued)

*Primary Examiner* — Sikha Roy
(74) *Attorney, Agent, or Firm* — Patterson & Sheridan LLP

(57) ABSTRACT

According to one embodiment, a lamp apparatus includes a light-emitting module, housing, and a lighting circuit. The light-emitting module includes a light-emitting element. The housing opens in the direction of irradiation of a light beam and having a cap on a side opposite from the direction of irradiation of the light beam. The cap is provided with a light-emitting module mounting portion projecting in the direction of irradiation of the light beam and the light-emitting module is mounted on the light-emitting module mounting portion. The lighting circuit is accommodated in the housing.

10 Claims, 9 Drawing Sheets

(51) Int. Cl.

| | |
|---|---|
| ***F21K 99/00*** | (2010.01) |
| ***F21V 23/00*** | (2006.01) |
| ***F21V 17/00*** | (2006.01) |
| ***F21S 8/02*** | (2006.01) |
| *F21V 7/09* | (2006.01) |
| *F21V 3/02* | (2006.01) |
| *F21Y 101/02* | (2006.01) |

(56) References Cited

U.S. PATENT DOCUMENTS

| | | | | |
|---|---|---|---|---|
| 2009/0154180 | A1* | 6/2009 | Cho et al. | 362/459 |
| 2009/0213595 | A1 | 8/2009 | Alexander et al. | |
| 2009/0315442 | A1* | 12/2009 | Rooymans | 313/46 |
| 2010/0026157 | A1* | 2/2010 | Tanaka et al. | 313/45 |
| 2010/0127637 | A1 | 5/2010 | Alexander et al. | |
| 2011/0063849 | A1* | 3/2011 | Alexander et al. | 362/294 |
| 2012/0127739 | A1* | 5/2012 | Takahara et al. | 362/373 |
| 2012/0127741 | A1* | 5/2012 | Osada et al. | 362/373 |
| 2014/0153250 | A1* | 6/2014 | Matsushita et al. | 362/294 |

FOREIGN PATENT DOCUMENTS

| | | | |
|---|---|---|---|
| JP | H06-291226 | A | 10/1994 |
| JP | 2010-147000 | | 7/2010 |
| JP | 2010-153963 | A | 7/2010 |
| JP | 2010-157377 | A | 7/2010 |
| JP | 2010-219290 | A | 9/2010 |
| JP | 2010-262781 | | 11/2010 |
| JP | 2012-069396 | A | 4/2012 |
| WO | 2010-107781 | A2 | 9/2010 |

OTHER PUBLICATIONS

European Search Report dated Mar. 14, 2013 filed in European Counterpart Application No. 12152507.5-1757/2481973, 10 pages.

Japanese Office Action dated Jan. 29, 2014 for Application No. 2011-019006.

Japanese Office Action dated May 19, 2014 for Application No. 2011-019005.

Japanese Office Action dated Sep. 22, 2014 for Application No. 2011-019006.

* cited by examiner (a)

(b)

LUMINAIRE AND LAMP APPARATUS HOUSING

INCORPORATION BY REFERENCE

The present invention claims priority under 35 U.S.C. §119 to Japanese Patent Application Nos. 2011-019005, 2011-019006 and 2011-079079 filed on Jan. 31, 2011, Jan. 31, 2011 and Mar. 31, 2011, respectively. The contents of these applications are incorporated herein by reference in their entirety.

FIELD

Embodiments described herein relates to a lamp apparatus using a light-emitting element, and a luminaire using the lamp apparatus.

BACKGROUND

In the related art, examples of a lamp apparatus using a light-emitting element include, for example, a flat-type lamp apparatus using a GX53-type cap. The lamp apparatus of this type includes a housing opening in the direction of irradiation of a light beam and having a cap on the side opposite from the direction of irradiation of the light beam, and a light-emitting module having a light-emitting element and a lighting circuit configured to light the light-emitting element are accommodated in the housing.

In such a lamp apparatus, the light-emitting module is arranged on an inner surface of the cap in the innermost side in the housing so that a light beam generated by lighting of the light-emitting element of the light emitting module is radiated from the opening side of the housing. Also, by causing an outer surface of the cap to come into contact with the side of a luminaire in a state in which the lamp apparatus is mounted on the luminaire, heat generated when lighting of the light-emitting element is radiated by heat conduction from the cap toward the luminaire.

However, in the lamp apparatus having the light-emitting module mounted on the inner surface of the cap, the light-emitting module is positioned on the innermost side in the housing. Therefore, luminous intensity distribution is limited to a narrow angle and a wide angle of the luminous intensity distribution can hardly be achieved, and hence flexibility of luminous intensity distribution control is low.

In contrast, if the thickness of the entire cap is simply increased and the light-emitting module is positioned on the side of the opening of the housing, the lamp apparatus unfavorably grows in mass.

The problem to be solved by the embodiments described herein is to provide a lamp apparatus which achieves improvement of flexibility of luminous intensity distribution control and alleviate an increase of mass without lowering a heat radiation performance and a luminaire using such a lamp apparatus.

BRIEF DESCRIPTION OF THE DRAWINGS

FIG. 5(*b*) is a schematic drawing showing a comparative example;

FIG. 6(*b*) is an enlarged cross-sectional view showing part of the lamp apparatus and the luminaire in the state shown in FIG. 6(*a*);

FIG. 6(*c*) is a cross-sectional view of a heat conductive sheet;

FIG. 6(*d*) is an enlarged cross-sectional view of part of the heat conductive sheet;

FIG. 6(*e*) is a cross-sectional view showing a state in which the heat conductive sheet is interposed between the cap of the lamp apparatus and the heat radiator of the luminaire;

DETAILED DESCRIPTION

A lamp apparatus according to embodiments includes a light-emitting module, a housing, and a lighting circuit. The light-emitting module includes a light-emitting element. The housing opens in the direction of irradiation of a light beam and having a cap on the side opposite from the direction of irradiation of the light beam. The cap is provided with a light-emitting module mounting portion projecting in the direction of irradiation of the light beam and the light-emitting module is mounted on the light-emitting module mounting portion. The lighting circuit is accommodated in the housing.

The lamp apparatus allows improvement of flexibility of luminous intensity distribution control and reduction of increase in mass without lowering a heat radiation performance of the lamp apparatus.

Referring now to FIG. 1 to FIG. 8, a first embodiment will be described.

Figure 7:
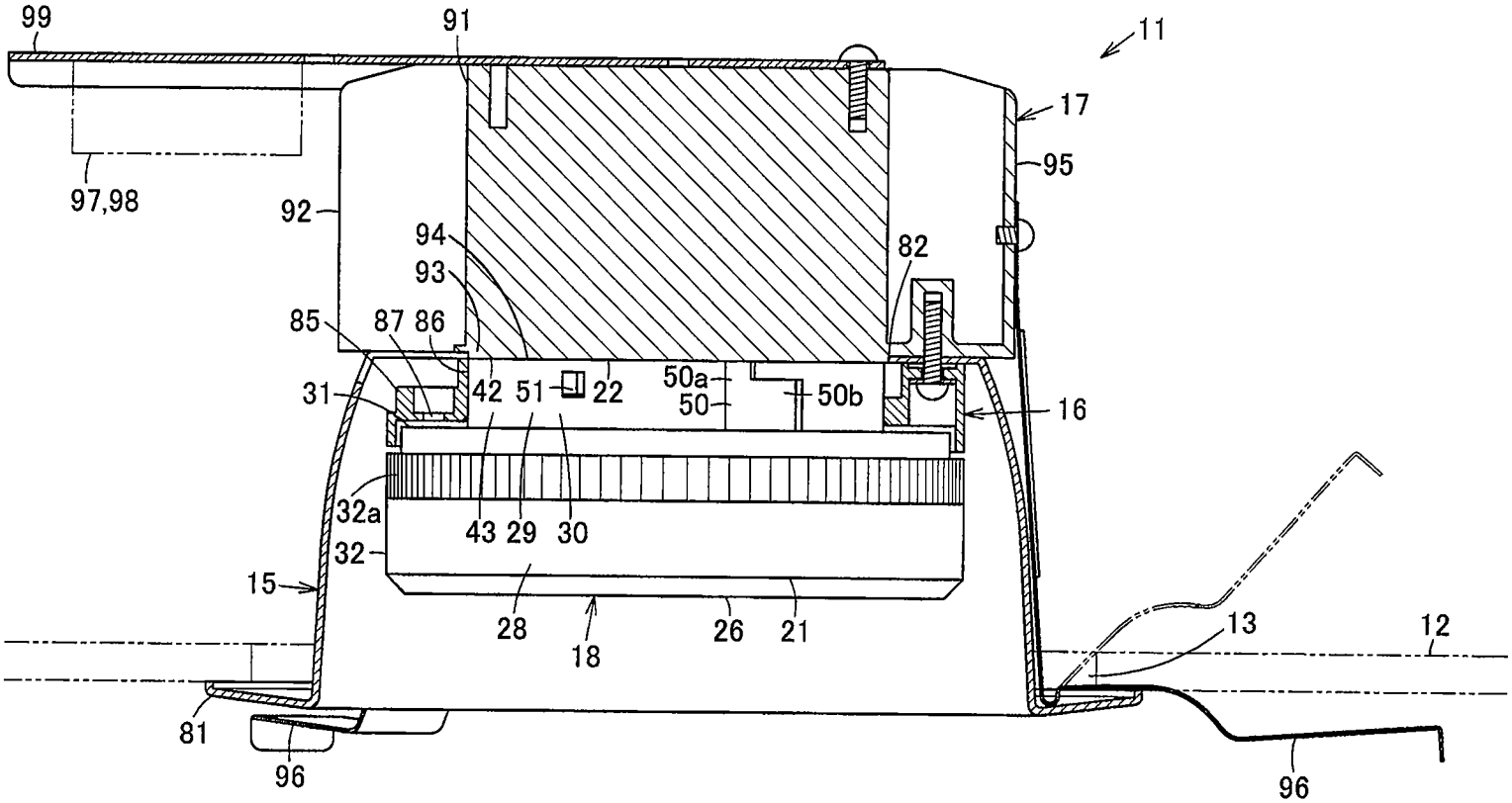
FIG. 7 is a cross-sectional view of the luminaire in which the lamp apparatus according to the embodiment is used.
Figure 8:
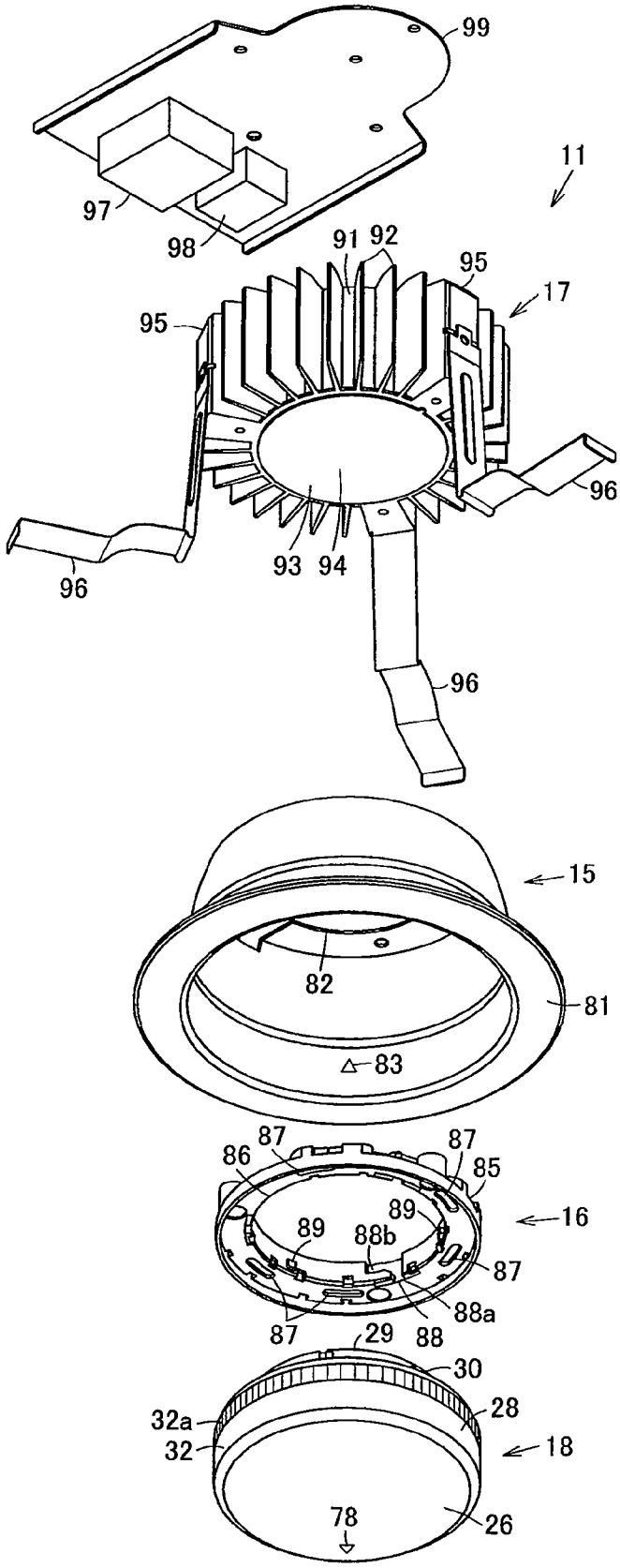
FIG. 8 is an exploded perspective view of the lamp apparatus.

As shown in FIG. 7 and FIG. 8, a luminaire 11 is a recessed type luminaire such as a downlight, and is installed in a circular embedding hole 13 provided in an installed portion 12 such as a ceiling panel in an embedded state.

The luminaire 11 includes a luminaire body 15, a socket 16 and a heat radiator 17 fixed integrally with the luminaire body 15, and a flat-type lamp apparatus 18 demountably mounted in the socket 16. Then, the luminaire 11 is configured to radiate heat generated when the lamp apparatus 18 is lit mainly by heat conduction to the heat radiator 17.

In the description given below, with reference to a state in which the luminaire 11 is installed horizontally, and the flat-type lamp apparatus 18 is mounted horizontally to the luminaire 11, the direction in which the lamp apparatus 18 irradiates a light beam is referred to as "down", and the direction opposite from the direction of irradiation of the light beam is referred to as "up".

As shown in FIG. 1 to FIG. 4, the lamp apparatus 18 includes a flat and cylindrical housing 21, a heat conductive sheet 22 mounted on an upper surface of the housing 21, a light-emitting module 23, an optical component 24, and a lighting circuit 25 accommodated in the housing 21, and a translucent cover 26 attached to a lower side of the housing 21.

The housing 21 includes a cylindrical case 28, and a cylindrical cap member 29 to be attached to an upper surface of the case 28. The upper surface side of the case 28 and the cap member 29 projecting from the upper surface of the case 28 constitutes a cap 30 having a predetermined standard size.

The case 28 is formed of, for example, synthetic resin having insulating properties, and includes a flat plate portion 31 on an upper surface and a peripheral surface portion 32 projecting downward from a peripheral portion of the flat plate portion 31. A lower surface of the case 28 is formed with an opening 28*a*.

The flat plate portion 31 is formed with an insertion hole 33 at the center thereof and is formed with a plurality of mounting holes 34 on the radially outside with respect to the insertion hole 33, and a plurality of insertion holes 35 formed on the radially outside with respect to the mounting holes 34. Formed on the peripheral portion of the flat plate portion 31 and an edge portion of the insertion hole 33 are an annular substrate supporting portion 36 on the outer peripheral side which supports the lighting circuit 25 (a circuit board 68) and an annular substrate supporting portion 37 on an inner peripheral side, respectively. The substrate supporting portion 36 on the outer peripheral side is formed into a groove shape so as to allow the lighting circuit 25 (the circuit board 68) to be fitted therein (See FIG. 2, detailed illustration is not given in FIG. 1). A wiring guide portion 38 which is positioned radially outside of the substrate supporting portion 37 and projects downward with respect to the substrate supporting portion 37 is formed at a position on the substrate supporting portion 37 on the inner peripheral side, and the wiring guide portion 38 defines a wiring channel 39 which communicates with the upper and lower surfaces of the flat plate portion 31 and the insertion hole 33. The wiring guide portion 38 includes a pair of side wall portions 38*a* formed radially outward from the substrate supporting portion 37, and an outer wall portion 38*b* formed on the radially outside of the pair of the side wall portions 38*a*, thereby being formed into an angular C-shape in cross-section.

Formed on an inner peripheral surface of the peripheral surface portion 32 are a plurality of optical component supporting portions 40 which support the optical component 24, and a plurality of mounting grooves 41 in the vicinity of the opening 28*a*. One of the optical component supporting portions 40 is formed with a rib 40*a* which blocks the rotation of the optical component 24. Formed on an outer peripheral surface of the peripheral surface portion 32 on the upper side are irregular portions 32*a* for increasing the surface area.

The cap member 29 is formed of, for example, a metallic material such as aluminum diecast, and includes a cap surface 42 on an upper surface thereof, and a peripheral surface portion 43 projecting downward from the periphery of the cap surface 42. Formed on the inner side of the peripheral surface portion 43 are a plurality of bosses 45 into which a plurality of screws 44 for fixing the case 28 and the cap member 29 through the plurality of mounting holes 34 of the case 28 are screwed. The cap member 29 may be formed of ceramics or a material superior in heat conductivity such as resin.

A peripheral portion of the cap surface 42 is formed to have a predetermined thickness, which is the same as the peripheral surface portion 43, and part of a lower surface of the cap surface 42, for example, a center portion of the cap surface 42 is thicker than the peripheral portion, and is formed integrally with a light-emitting module mounting portion 46 projecting from the lower surface of the cap surface 42 toward the opening 28*a* of the housing 21, that is, in the direction of irradiation of the light beam.

The light-emitting module mounting portion 46 includes one surface (upper surface) which constitutes one flat surface of an outline of the cap 30 and the other surface (lower surface) to which the light-emitting module 23 is mounted, and is formed into a frustum shape having the one surface whose surface area is larger than the surface area of the other surface, that is, two to four times the surface area of the other surface. In addition, the light-emitting module mounting portion 46 is formed so as to be widened from an outer periphery of the other surface toward the one surface. The shape of an inclined surface around the light-emitting module mounting portion 46 between the lower surface side and the upper surface side may either be an arcuate shape or a straight shape. The shape or the surface area of a mounting surface 47 on the lower surface side of the light-emitting module mounting portion 46 corresponds to the shape or the surface area of the light-emitting module 23. The position on the upper surface side of the light-emitting module mounting portion 46 (at the foot of the frustum shape) may be positioned inside the peripheral portion of the lower surface of the cap surface 42, or may be positioned in the peripheral portion of the cap surface 42.

The height of the light-emitting module mounting portion 46 projecting from the cap surface 42 is set arbitrary according to the relation of the luminous intensity distribution control. For example, the luminous intensity distribution of the lamp apparatus 18 can be set arbitrarily by preparing the cap members different in the height of the light-emitting module mounting portions 46 and selecting one of the cap members 29 according to the luminous intensity distribution control.

Formed on the lower surface of the light-emitting module mounting portion 46 is the flat mounting surface 47 to which the light-emitting module 23 is mounted by thermal connection. The mounting surface 47 is formed with a plurality of mounting holes 48 for securing the light-emitting module 23 with screws.

The peripheral surface portion 43 is formed with a plurality of key grooves 50. The key grooves 50 each are formed into a substantially L-shape including a vertical groove 50*a* formed so as to communicate with an upper surface of the cap member 29 along the vertical direction, and a lateral groove 50*b* formed on a lower portion of the peripheral surface portion 43 along the peripheral direction of the peripheral surface portion 43. In addition, the peripheral surface portion 43 is formed with a plurality of keys 51 so as to project between the plurality of key grooves 50. In this embodiment, three each of the key grooves 50 and the keys 51 are provided. However, what is required is at least two each of the key grooves 50 and the keys 51 are provided, and there may be provided four or more each of the key grooves 50 and the keys 51.

Figure 6:
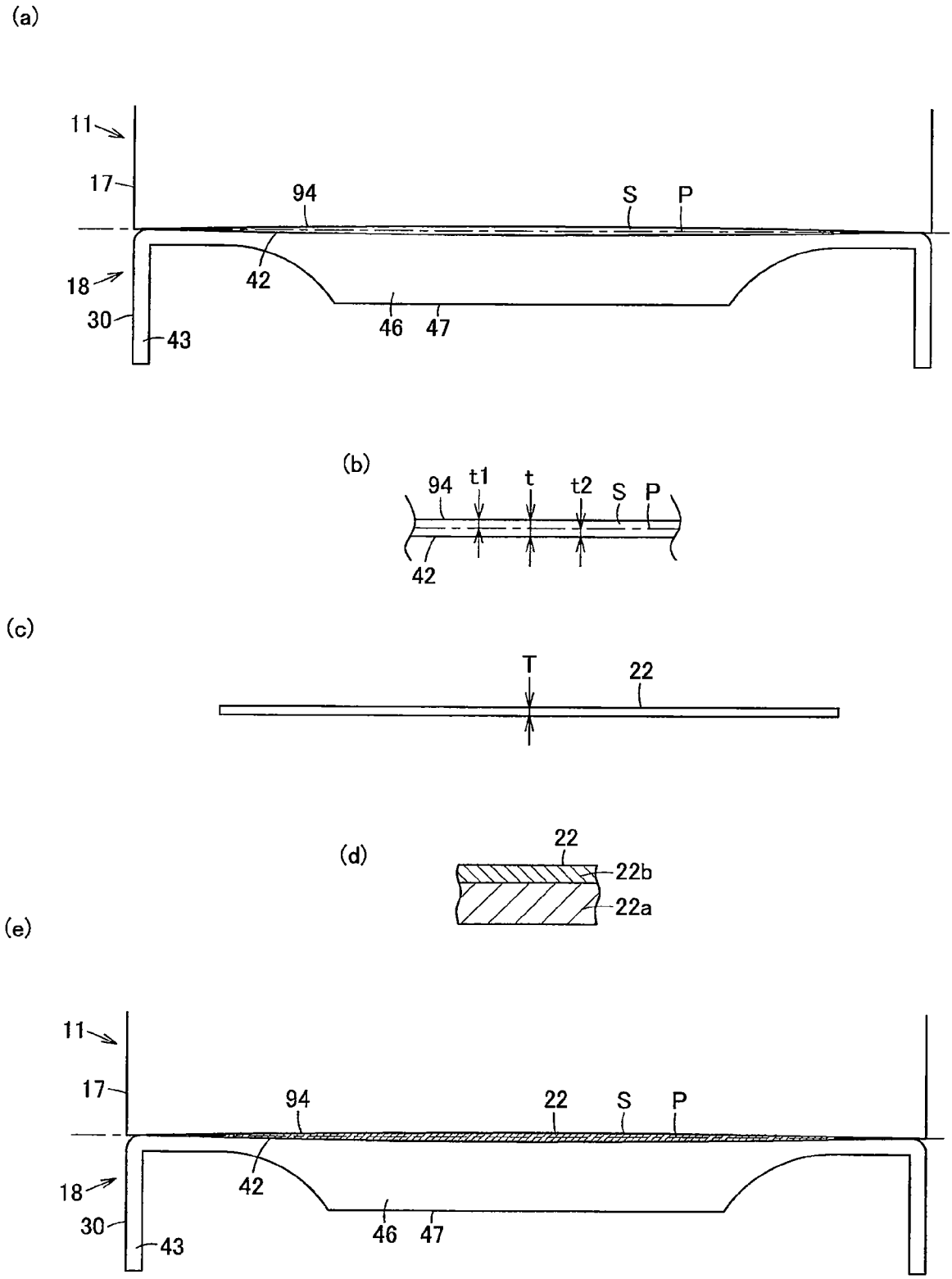
FIG. 6(*a*) is a cross-sectional view showing parts of the lamp apparatus and a luminaire in a state in which a cap of the lamp apparatus and a heat radiator of the luminaire are brought into contact with each other.

The heat conductive sheet 22 is mounted on the upper surface of the cap surface 42 of the cap member 29, and is configured to come into contact with the heat radiator 17 and allows efficient heat conduction from the lamp apparatus 18 to the heat radiator 17 when the lamp apparatus 18 is mounted on the luminaire 11. The surface area or the width of the heat conductive sheet 22 is formed to be larger than the surface area or the width of the light-emitting module mounting portion 46 on the upper surface side. The heat conductive sheet 22 is formed into a disk shape, including a silicone sheet 22*a* having resiliency and being adhered to the cap surface 42 of the cap member 29 and a metal foil 22*b* formed of aluminum, tin or zinc and being adhered to an upper surface of the silicone sheet 22*a* as shown in FIG. 6(*c*) for example. The surface of the metal foil 22*b* has a low frictional resistance in comparison with the surface of the silicone sheet 22*a*. The shape of the heat conductive sheet 22 may be a polygonal shape such as a hexagonal shape instead of the circular shape.

The light-emitting module 23 includes a substrate 53, a light-emitting portion 54 formed on a lower surface of the substrate 53, a connector 55 mounted on the lower surface of the substrate 53, a frame-shaped holder 56 configured to hold the periphery of the substrate 53, and a heat conductive sheet 57 interposed between the substrate 53 and the mounting surface 47 of the light-emitting module mounting portion 46 of the cap member 29 where the substrate 53 is attached.

The substrate 53 is formed of a material such as metal or ceramics superior in heat conductivity into a flat panel shape, for example.

The light-emitting portion 54 employs a light emitting element referred to as a semiconductor light-emitting element such as an LED element or EL element as a light source. In this embodiment, the LED element is employed as the light-emitting element, and a COB (Chip On Board) system having a plurality of LED elements mounted on a substrate is employed. In other words, the plurality of LED elements are mounted on the substrate, the plurality of LED element are electrically connected to one another in series by wire bonding, and the plurality of LED elements are integrally covered with a fluorescent layer, which is a transparent resin such as silicone resin mixed with a phosphor and sealed. As the LED elements, for example, LED elements emitting blue light are used, and the fluorescent layer is mixed with a phosphor excited by part of the blue light from the LED element and radiating yellow light. Therefore, the light-emitting portion 54 is formed of the LED element and the fluorescent layer, and a surface of the fluorescent layer, which is a surface of the light-emitting portion 54, serves as a light-emitting surface, so that a white illuminating light beam is radiated from the light-emitting surface. As the light-emitting portion, a system of mounting a plurality of SMD (Surface Mount Device) packages having connection terminals and having the LED elements mounted thereon on the substrate may be employed.

The connector 55 is electrically connected with the light-emitting element.

The holder 56 is fixed to the light-emitting module mounting portion 46 of the cap member 29 in a state of holding the substrate 53 with the heat conductive sheet 57 clamped therebetween with a plurality of screws 58 screwed into the plurality of mounting holes 48 formed in the light-emitting module mounting portion 46 of the cap member 29. Accordingly, the substrate 53 is bonded to the light-emitting module mounting portion 46 of the cap member 29 via the heat conductive sheet 57 with a pressure, and hence favorable heat conductivity from the substrate 53 to the cap member 29 is ensured.

The heat conductive sheet 57 may be a metal foil of aluminum, tin, or zinc for example, instead of the silicone sheet. By using the metal foil, deterioration due to heat is smaller than the silicone sheet, and hence the heat conductive performance can be maintained for a long time.

The optical component 24 is configured of a cylindrical reflector 60. The reflector 60 is, for example, formed of synthetic resin having insulative properties, is formed with a cylindrical light guide portion 61 opened on top and bottom and extending in diameter step by step or continuously from an upper end side toward a lower end side, and the light guide portion 61 is formed with an annular cover portion 62 covering the periphery of the lower surface of the case 28 at an lower end thereof. Reflecting surfaces 63 having a high coefficient of light reflection such as a white surface or a mirror surface are formed on an inner surface of the light guide portion 61 and on a lower surface of the cover portion 62. As a method of forming the reflecting surface 63, a method of vapor deposition of aluminum or the like may be employed. In this case, electrically insulating properties may be improved by masking an outer peripheral portion of the cover portion 62 and forming a non-vapor-deposited surface.

The light guide portion 61 projects into the cap member 29 through the lighting circuit 25 (the circuit board 68) and the insertion hole 33 of the case 28 and is arranged so as to surround the light-emitting portion 54. A substrate fitting portion 64 fitted into the lighting circuit 25 (the circuit board 68) is formed on an outer peripheral surface of the light guide portion 61 at an intermediate section in the vertical direction and a substrate holding portion 65 configured to hold the lighting circuit 25 (the circuit board 68) between the substrate supporting portions 36, 37 of the case 28 is formed on the substrate fitting portion 64.

The cover portion 62 is formed with a plurality of holding claws 66 supported by the respective optical component supporting portions 40 of the case 28. As an embodiment, one of the holding claws 66 is fitted into the rib 40*a* of one of the optical component supporting portions 40, and the reflector 60 is blocked by the case 28 so as not to be rotated.

Figure 1:
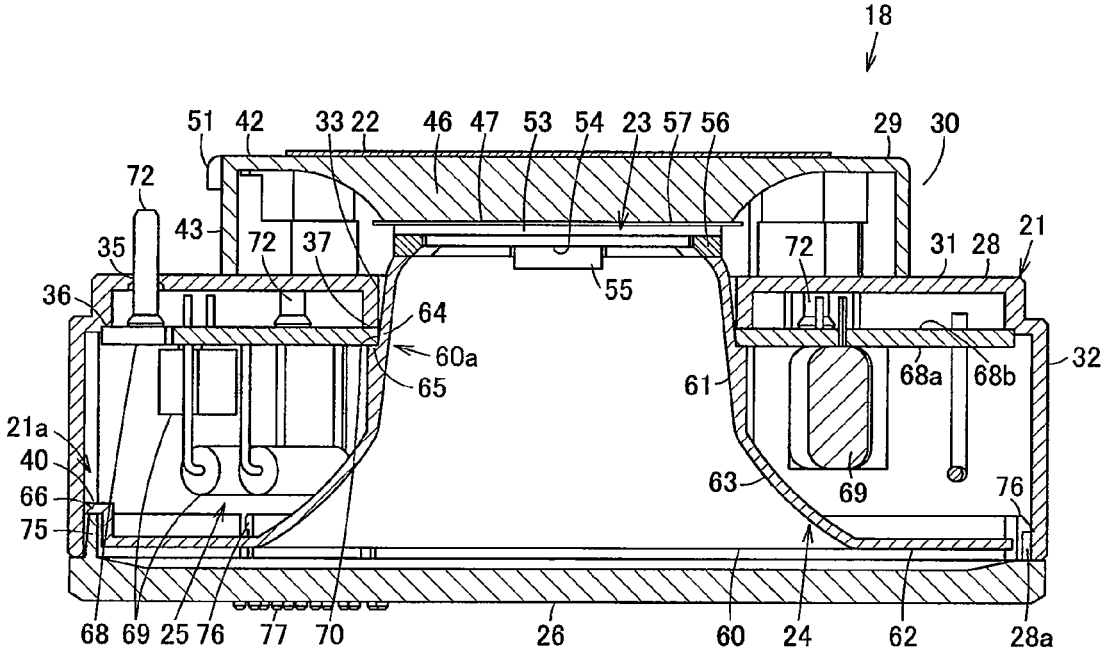
FIG. 1 is a cross-sectional view of a lamp apparatus according to a first embodiment.
Figure 2:
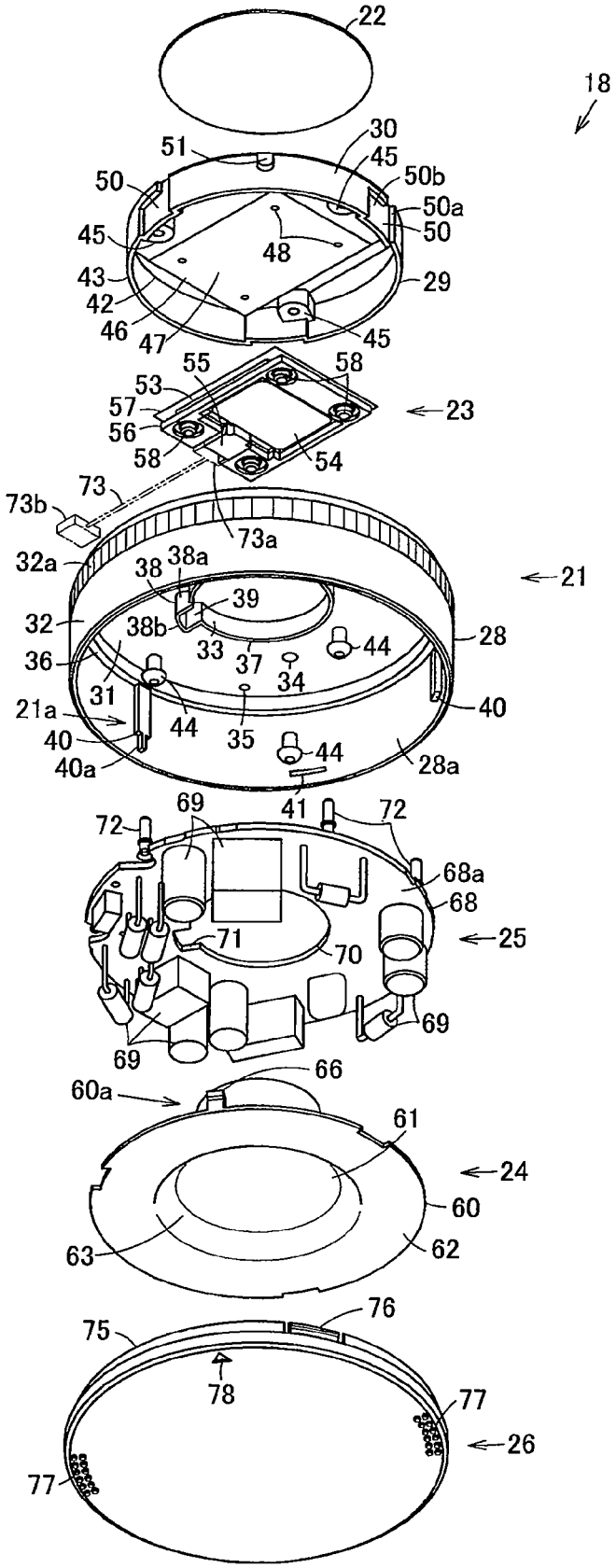
FIG. 2 is an exploded perspective view of the lamp apparatus.
Figure 3:
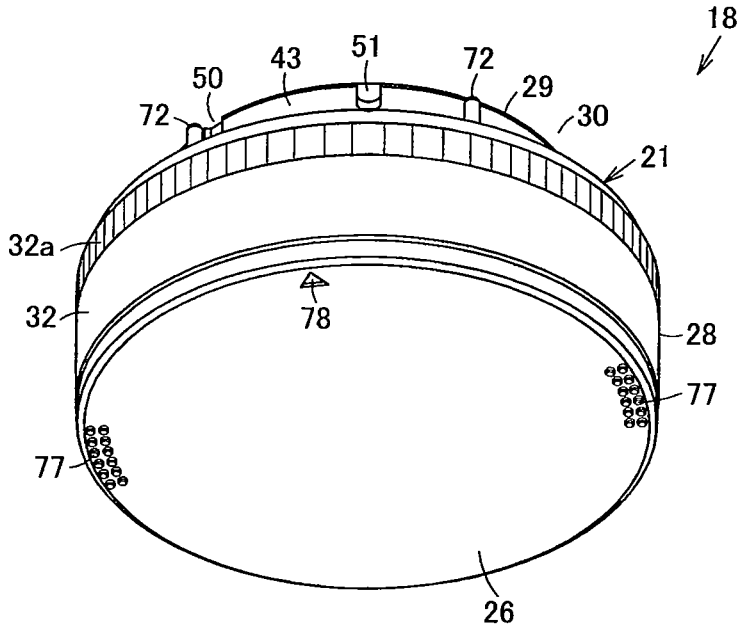
FIG. 3 is a perspective view of the lamp apparatus showing one surface.
Figure 4:
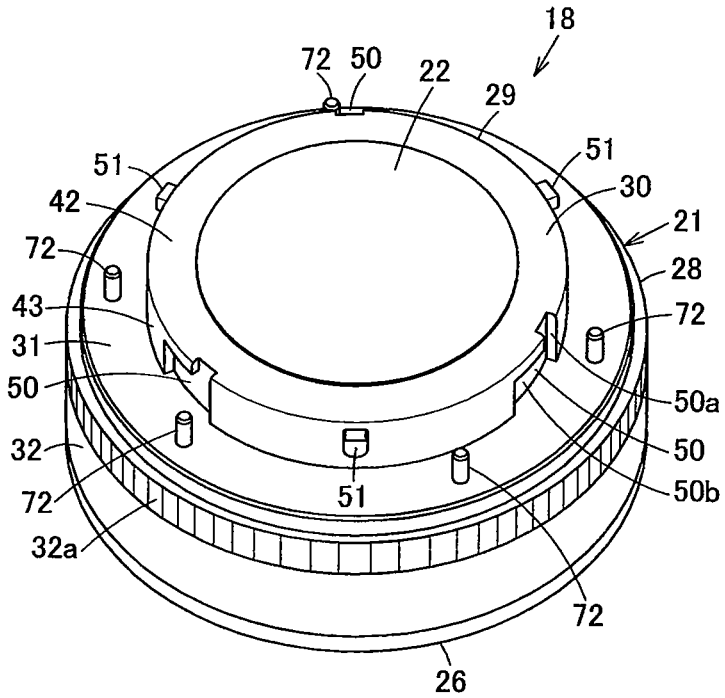
FIG. 4 is a perspective view of the lamp apparatus showing the other surface.

Then, a plurality of the reflectors 60 having different luminous intensity distribution properties are provided depending on the luminous intensity distribution control required by the lamp apparatus 18, and one of the plurality of reflectors 60 of a type corresponding to the luminous intensity distribution control required by the lamp apparatus 18 is selected and used from among the plurality of types of the reflectors 60. For example, FIG. 2 shows the lamp apparatus 18 employing the reflectors 60 having a shape of a wide angle type which provides a wide luminous intensity distribution. The reflectors 60 are different mainly in the shape of the light guide portions 61 depending on the types. However, the substrate fitting portion 64 and the substrate holding portion 65 of the light guide portion 61, and the holding claws 66 of the cover portion 62 are common to the respective types, any types of the reflectors 60 can be accommodated in the housing 21 commonly. The plurality of types of the reflectors 60 different in the luminous intensity distribution properties include a wide angle type, a middle angle type, a narrow angle type having a narrow luminous intensity distribution, and other types.

Therefore, the substrate fitting portion 64 and the substrate holding portion 65 of the reflectors 60 or the holding claws 66 of the cover portion 62 are formed as a common mounting portion 60*a* having a shape common to the types having different luminous intensity distribution properties. The substrate supporting portion 37 or the optical component supporting portions 40 of the housing 21 are configured as a common mounted portion 21*a* having a common shape on which the common mounting portion 60*a* of the reflectors 60 is mounted.

Furthermore, the type of the reflectors 60 is not limited to the shape, and the luminous intensity distribution control is also possible by the luminous intensity distribution properties of the reflecting surfaces 63. If the color is white, a wider luminous intensity distribution is achieved, and if a mirror surface is employed, a narrower luminous intensity distribution is achieved. Then, any types of the reflectors 60 may be used by being commonly accommodated in the housing 21.

The lighting circuit 25 includes, for example, a circuit which rectifies and smoothens a commercial source voltage, and a DC/DC converter having a switching element which switches at high frequencies from several kilohertz to several hundreds of kilohertz and constitutes a power circuit which outputs a constant-current DC power. The lighting circuit 25 includes the circuit board 68 and circuit components 69 which are a plurality of electronic components mounted on the circuit board 68.

The circuit board 68 is formed into an annular shape formed with a circular opening 70 through which an upper side of the light guide portion 61 of the reflectors 60 penetrates and the substrate fitting portion 64 is fitted at a center portion thereof. An outer diameter of the circuit board 68 is formed into a size fitted into the substrate supporting portion 36 of the case 28. Formed at an end portion of the opening 70 is a notched portion 71 which is a wiring hole in which the wiring guide portion 38 of the case 28 is inserted and fitted.

A lower surface of the circuit board 68 is a mounted surface 68*a* on which a discrete component having a lead wire from among the circuit components 69 is mounted, and an upper surface of the circuit board 68 is a wiring pattern surface 68*b* on which a wiring pattern is formed for connecting the lead wire of the discrete component and mounting surface-mounted components from among the components of the lighting circuit.

From among the circuit components 69 mounted on the mounted surface 68*a* of the circuit board 68, at least one, preferably all of a large component having a large projecting height from the circuit board 68, a heat generating component generating a large amount of heat, and a component being weak against heat such as electrolytic capacitor are mounted on the circuit board 68 at a position close to the outside. Mounted on the mounted surface 68*a* of the circuit board 68 is a connector (not shown) which is connected to the light-emitting module 23 by an electric wire 73 at a position in the vicinity of the notched portion 71. Mounted on the annular circuit board 68 is a component which generates noise such as a switching element at a position away in the direction opposite from the position of a power input unit in the circumferential direction.

Then, the circuit board 68 is arranged on the upper side in the case 28 in a state in which the wiring pattern surface 68*b* facing the flat plate portion 31 of the case 28 in parallel. The circuit components 69 mounted on the mounted surface 68*a* of the circuit board 68 are arranged between the peripheral surface portion 32 of the case 28 and the light guide portion 61 and the cover portion 62 of the reflectors 60.

A plurality of lamp pins 72 electrically connected to the circuit board 68 are press-fitted into the respective insertion holes 35 of the case 28 and project vertically upward of the case 28. In other words, the plurality of lamp pins 72 project vertically from an upper surface of the cap 30. The plurality of lamp pins 72 include at least two power input lamp pins 72 and, in addition, may include two lamp pins 72 for a light modulating signal or one lamp pin 72 for grounding. In other words, at least two lamp pins 72 for the power source must only be provided, and other lamp pins 72 are not necessary. Alternatively, dummy pins to be fixedly press-fitted into the insertion holes 35 of the case 28 without being connected to the circuit board 68 may be provided. The lamp pins 72 may be fixedly press-fitted into the insertion holes 35 of the case 28 and electrically connected to the circuit board 68 by a lead wire, or the lamp pins 72 are provided on the circuit board 68 so as to extend upright and connected directly to the circuit board 68.

Also, an output terminal of a DC power source of the lighting circuit 25 and the connector 55 of the light-emitting module 23 are electrically connected by the electric wire 73. For example, an electric wire with connectors 73*a*, 73*b* at both ends thereof is used as the electric wire 73, the connector 73*a* at one end thereof is connected to the connector 55 of the light-emitting module 23, and the connector 73*b* at the other end thereof is connected to a connector of the circuit components 69 mounted on the circuit board 68. The electric wire 73 is inserted into the wiring channel 39 of the wiring guide portion 38, and penetrates through the circuit board 68.

The translucent cover 26 is formed of synthetic resin or glass into a disk shape so as to have translucency and diffusibility, and is mounted to the case 28 so as to cover the opening 28*a*. Formed on the translucent cover 26 on a peripheral portion of an upper surface thereof is a fitting portion 75 which is to be fitted into the inner periphery of the peripheral surface portion 32 of the case 28, and the fitting portion 75 is formed with a plurality of locking claws 76 locked with the respective mounting grooves 41 of the peripheral surface portion 32 of the case 28. In the state in which the respective locking claws 76 are locked with the respective mounting grooves 41, the respective holding claws 66 of the reflectors 60 are clamped and held between the fitting portion 75 and the respective optical component supporting portions 40. It is also applicable to clamp and hold the optical component 24 between the fitting portion 75 of the translucent cover 26 and the circuit board 68 without using the optical component supporting portions 40 of the case 28 (in this case, reinforcing ribs may be used instead of the optical component supporting portions 40).

On a peripheral portion of a lower surface of the translucent cover 26, finger placing portions 77 including a plurality of projections are provided so as to project from a plurality of, for example, two positions on the circumference of the translucent cover 26, and a triangular mark 78 indicating a mounting position with respect to the luminaire 11 is formed at one position. The shape of the finger placing portions 77 is arbitrary, and preferably does not impair the appearance (having low profile), does not work against the luminous intensity distribution, and is easy to operate when mounting and demounting the lamp apparatus 18 as described later.

The luminous intensity distribution control of the lamp apparatus 18 is also possible by the translucent cover 26, so that the types of the luminous intensity distribution properties different depending on the luminous intensity distribution control required by the lamp apparatus 18 may be used. For example, there are types different in degree of diffusion of the translucent cover 26 or in presence or absence of the Fresnel lens.

Then, in the lamp apparatus 18 configured in this manner, the lighting circuit 25 is arranged in the case 28, and the light-emitting module 23 is arranged in the cap member 29, which is a position in the case 28 on the side of the cap 30 with respect to the position of the lighting circuit 25, and the light-emitting module 23 is thermally connected and attached to the cap member 29. The light guide portion 61 of the reflectors 60 is arranged in the opening 70 of the circuit board 68 and the insertion hole 33 of the case 28, and the lighting circuit 25 in the case 28 is covered with and shielded by the cover portion 62 of the reflectors 60.

In the lamp apparatus 18 of this embodiment, an input power (power consumption) of the light-emitting module 23 is 20 to 25 w, and an entire luminous flux is 1100 to 1650 lm.

Subsequently, as shown in FIG. 7 and FIG. 8, the luminaire body 15 of the luminaire 11 is also used as the reflector, and is formed to open downward. A flange portion 81 projecting sideward is formed at a lower end of the luminaire body 15, and a fitting hole 82 is formed on an upper surface of the luminaire body 15. A triangle mark 83 indicating the mounting position of the lamp apparatus 18 is provided at one position on an inner peripheral surface of the luminaire body 15.

The socket 16 includes a socket body 85 formed of, for example, a synthetic resin having insulating properties into an annular shape and a plurality of terminals, not shown, arranged in the socket body 85.

Formed at the center of the socket body 85 is an insertion opening 86 where the cap member 29 of the lamp apparatus 18 is inserted. The socket body 85 is formed with a plurality of elongated connecting grooves 87 where the respective lamp pins 72 of the lamp apparatus 18 are inserted on a lower surface thereof along the peripheral direction.

Formed on an inner peripheral surface of the socket body 85 are a plurality of key grooves 88. The key grooves 88 each are formed into a substantially L-shape including a vertical groove 88*a* formed along the vertical direction, and a lateral groove 88*b* formed along the circumferential direction on an upper side of the socket body 85. In addition, the inner peripheral surface of the socket body 85 is formed with a plurality of keys 89 so as to project between the plurality of key grooves 88. The respective key grooves 88 and the respective keys 89, and the respective keys 51 and the key grooves 50 of the lamp apparatus 18 correspond to each other so that the lamp apparatus 18 can be demountably mounted on the socket 16.

The respective terminals are arranged on an upper side of the respective connecting grooves 87, and the lamp apparatus 18 is mounted on the socket 16, whereby the respective lamp pins 72 inserted into the respective connecting grooves 87 are electrically connected.

The heat radiator 17 is formed of a material such as a metal like aluminum diecast, ceramics, or a resin superior in heat radiating performance. The heat radiator 17 includes a cylindrical base portion 91 and a plurality of heat radiating fins 92 projecting radially from the periphery of the base portion 91.

Formed on a lower surface of the base portion 91 at a center portion is a fitting portion 93 configured to close the lower surface of the base portion 91 and having a circular shape, and a flat shaped connecting surface 94 is formed on a lower surface of the fitting portion 93.

Formed on the periphery of the base portion 91 of the heat radiator 17 are a plurality of mounting portions 95, and a mounting spring 96 for mounting the luminaire 11 to the installed portion 12 is mounted on the mounting portions 95.

A mounting plate 99 on which a terminal base 97 for a power source and a terminal base 98 for a light modulating signal are mounted is mounted on an upper surface of the heat radiator 17.

Then, the luminaire 11 is fixed with screws in a state in which the fitting hole 82 of the luminaire body 15 is fitted to the periphery of the fitting portion 93 of the heat radiator 17, and the luminaire body 15 is clamped between the heat radiator 17 and the socket 16. Above the insertion opening 86 of the socket 16, the connecting surface 94 of the heat radiator 17 is arranged.

Subsequently, assembly of the lamp apparatus 18 will be described.

The heat conductive sheet 22 and the light-emitting module 23 are mounted on the cap member 29. The electric wire 73 connected to the connector 55 of the light-emitting module 23 is drawn from the insertion hole 33 into the case 28, and the cap member 29 is screwed to the case 28.

The lighting circuit 25 is inserted into the case 28, the notched portion 71 of the circuit board 68 is fitted to the wiring guide portion 38, the peripheral portion of the circuit board 68 is fitted to the substrate supporting portion 36 of the case 28, and the upper surface of the circuit board 68 in the inner peripheral side is brought into abutment with the substrate supporting portion 37. The lamp pins 72 press-fitted and fixed to the case 28 in advance, or to be press-fitted and fixed later are connected to the circuit board 68 by means of lapping or the like. When inserting the lighting circuit 25 into the case 28, the electric wire 73 is inserted into the wiring channel 39 of the wiring guide portion 38 and the electric wire 73 is connected to connector of the side of the mounted surface 68*a* of the circuit board 68.

The reflectors 60 are inserted into the case 28, and the light guide portion 61 of the reflectors 60 is inserted into the opening 70 of the circuit board 68 and the insertion hole 33 of the case 28, the substrate fitting portion 64 of the light guide portion 61 is fitted into the opening 70 of the circuit board 68, and the substrate holding portion 65 of the light guide portion 61 is brought into abutment with the circuit board 68. Also, the holding claws 66 of the reflectors 60 are arranged at a position opposing the optical component supporting portions 40 of the case 28.

The translucent cover 26 is fitted into the opening 28*a* of the case 28, and the locking claws 76 of the translucent cover 26 are locked with the mounting grooves 41 of the case 28. Accordingly, the fitting portion 75 of the translucent cover 26 comes into abutment with the holding claws 66 of the reflectors 60 and presses the holding claws 66 against the optical component supporting portions 40 so as to clamp and hold the holding claws 66 between the fitting portion 75 and the optical component supporting portions 40, and the substrate holding portion 65 of the reflectors 60 presses the circuit board 68 against the substrate supporting portions 36, 37, and holds the circuit board 68 by clamping the same between the substrate holding portion 65 and the substrate supporting portions 36, 37.

Therefore, by attaching the translucent cover 26 to the case 28, the circuit board 68 and the reflectors 60 are clamped and held between the case 28 and the translucent cover 26.

Subsequently, mounting of the lamp apparatus 18 on the luminaire 11 will be described.

The lamp apparatus 18 is inserted from an opening on a lower surface of the luminaire body 15, and the mark 78 indicated on the lamp apparatus 18 and the mark 83 indicated on an inner surface of the luminaire body 15 are aligned, and the lamp apparatus 18 is fitted into the socket 16.

Accordingly, the cap member 29 of the lamp apparatus 18 is fitted into the insertion opening 86 of the socket 16, then the respective keys 89 of the socket 16 enter the vertical grooves 50*a* of the respective key grooves 50 of the cap member 29, and the keys 51 of the cap member 29 enter the vertical grooves 88*a* of the respective key grooves 88 of the socket 16, the respective lamp pins 72 of the lamp apparatus 18 are inserted into the corresponding connecting grooves 87 on the socket 16, and then the upper surface of the cap member 29 comes into abutment with the connecting surface 94 of the heat radiator 17 via the heat conductive sheet 22. At this time, the heat conductive sheet 22 comes into abutment with the connecting surface 94 of the heat radiator 17 and is compressed thereby.

In a state in which the lamp apparatus 18 is pressed against the heat radiator 17, the lamp apparatus 18 is rotated by a predetermined angle in the mounting direction. Even when there is only a small space which allows insertion of fingers between a peripheral surface of the lamp apparatus 18 and the inner surface of the luminaire body 15 when rotating the lamp apparatus 18, the lamp apparatus 18 can be rotated easily by getting fingers caught by the finger placing portions 77 projecting from the lower surface of the translucent cover 26.

By rotating the lamp apparatus 18 in the mounting direction, the respective keys 89 of the socket 16 enter and are caught by the lateral grooves 50*b* of the respective key grooves 50 of the cap member 29 and the respective keys 51 of the cap member 29 enter and are caught by the lateral grooves 88*b* of the respective key grooves 88 of the socket 16, whereby the lamp apparatus 18 is mounted on the socket 16. The respective lamp pins 72 of the lamp apparatus 18 move in the respective connecting grooves 87 of the socket 16, and come to contact with and are electrically connected to the respective terminals arranged on the upper sides of the respective connecting grooves 87.

In the state in which the lamp apparatus 18 is mounted, the upper surface of the cap member 29 of the lamp apparatus 18 is thermally connected to the connecting surface 94 of the heat radiator 17 via the heat conductive sheet 22, that is, efficient heat conduction from the lamp apparatus 18 to the heat radiator 17 is achieved.

When demounting the lamp apparatus 18 from the luminaire 11, first of all, the lamp apparatus 18 is rotated in the demounting direction, which is a direction opposite from the mounting direction, whereby the respective keys 89 of the socket 16 move to the vertical grooves 50*a* of the respective key grooves 50 of the cap member 29 and the respective keys 51 of the cap member 29 move to the vertical grooves 88*a* of the respective key grooves 88 of the socket 16, so that the respective lamp pins 72 move in the respective connecting grooves 87 of the respective socket 16 away from the respective terminals arranged on the upper side of the respective connecting grooves 87. Subsequently, by moving the lamp apparatus 18 downward, the respective lamp pins 72 come apart from the respective connecting grooves 87 of the socket 16, the vertical grooves 50*a* of the respective key grooves 50 of the cap member 29 come apart from the respective keys 89 of the socket 16, then the respective keys 51 of the cap member 29 come apart from the vertical grooves 88*a* of the respective key grooves 88 of the socket 16, and then the cap member 29 come apart from the insertion opening 86 of the socket 16, so that the lamp apparatus 18 can be demounted from the socket 16.

Subsequently, lighting of the lamp apparatus 18 will be described.

When electricity is supplied from a power source line to the lighting circuit 25 via the terminal base 97, the terminals of the socket 16, and the lamp pins 72 of the lamp apparatus 18, a lighting power is supplied from the lighting circuit 25 to the light-emitting elements of the light-emitting module 23, so that the light-emitting elements are lit. Light radiated from the light-emitting portion 54 by lighting of the light-emitting elements travels in the light guide portion 61 of the reflectors 60, passes through the translucent cover 26, and is emitted from the opening on the lower surface of the luminaire body 15.

Heat that the light-emitting elements of the light-emitting module 23 generates when being turned ON is mainly conducted efficiently from the substrate 53 of the light-emitting module 23 to the light-emitting module mounting portion 46 of the cap member 29 connected thermally thereto via the heat conductive sheet 57, is conducted efficiently from the light-emitting module mounting portion 46 of the cap member 29 to the heat radiator 17 via the heat conductive sheet 22, and is radiated into air from the surface of the heat radiator 17 including the plurality of heat radiating fins 92.

Part of the heat conducted from the lamp apparatus 18 to the heat radiator 17 is conducted respectively to the luminaire body 15, the plurality of mounting springs 96 and the mounting plate 99, and is radiated into air also therefrom.

Heat that the lighting circuit 25 generates is conducted to the case 28 and the translucent cover 26, and radiated into air from the surfaces of the case 28 and the translucent cover 26.

Subsequently, the light-emitting module mounting portion 46 provided to the cap 30 of the lamp apparatus 18 will be described.

By providing the light-emitting module mounting portion 46 on the cap 30, the position of the light-emitting module 23 is arranged close to the opening 28*a* of the housing 21, so that the luminous intensity distribution can be controlled to a wide angle luminous intensity distribution. Then, the luminous intensity distribution of the lamp apparatus 18 can be set arbitrarily by preparing the cap members 29 different in the height of the light-emitting module mounting portions 46 and selecting one of the cap members 29 according to the luminous intensity distribution control.

Figure 5:
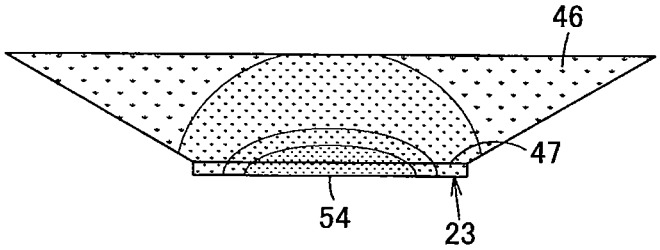
FIG. 5(*a*) is a schematic drawing showing how heat is conducted from a light-emitting module to a light-emitting module mounting portion of the lamp apparatus according to the embodiment.
Figure 5:
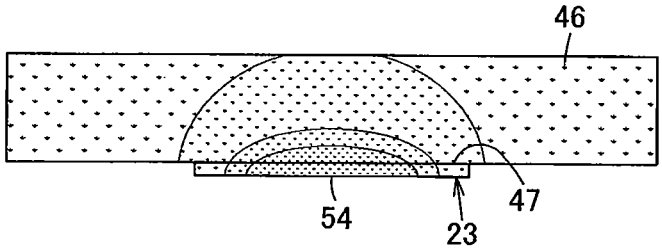

The light-emitting module mounting portion 46 may be formed into a frustum shape as in this embodiment shown in FIG. 5(*a*) and, alternatively, may be formed into a thick and flat shape as shown in FIG. 5 (*b*) having an uniform thickness entirely of the cap surface 42 of the cap member 29. In either case, flexibility of the luminous intensity distribution control may be improved.

FIGS. 5(*a*) and 5(*b*) show results of measurement indicating how the heat is conducted from the light-emitting module 23 to the light-emitting module mounting portion 46. The temperature distribution is shown by density of the contour and dot pattern, and it is understood that the temperature of the light-emitting portion 54 having the LED element, which is a heat generating source of the light-emitting module 23, is the highest and is decreased as it moves away from the light-emitting portion 54, and heat from the light-emitting portion 54 is radially conducted to the light-emitting module mounting portion 46.

The light-emitting module mounting portion 46 conducts the heat generated by the light-emitting module 23 from the upper surface of the cap surface 42 of the cap member 29, which is a surface opposite from the mounting surface 47 on which the light-emitting module 23 is mounted to the heat radiator 17 of the luminaire 11, whereby a favorable heat radiating performance is obtained. In contrast, favorable heat radiation cannot be obtained by the heat conduction from the surface of the light-emitting module mounting portion 46 exposed to an inner portion of the housing 21.

In this manner, from the point how the heat is conducted and the point of heat conduction, even when the thickness is increased in the peripheral portion of the mounting surface 47 of the light-emitting module mounting portion 46 as in the case of FIG. 5(*b*), sufficient improvement of the heat radiating performance cannot be expected.

Therefore, even when the light-emitting module mounting portion 46 is formed into a frustum shape as in this embodiment shown in FIG. 5(*a*), the heat radiating performance is not much affected.

Then, for the respective cases of FIGS. 5(*a*) and 5(*b*), when the temperature of the LED element of the light-emitting module 23 was measured in the state in which the lamp apparatus 18 is mounted on the luminaire 11, the maximum temperature in the case of FIG. 5(*b*) was 50.16° C. and the maximum temperature in the case of FIG. 5(*a*) was 50.26° C. These differences are within the allowable tolerance, and there is no difference in heat radiation performance.

Therefore, as in the embodiment shown in FIG. 5(*a*), by forming the light-emitting module mounting portion 46 into the frustum shape, the amount of the material used when forming the cap member 29 is reduced, and hence reduction of costs and improvement of productivity are achieved and, in addition, the mass of the cap member 29 is prevented from increasing and may be limited easily to an upper limit value of the mass defined for the lamp apparatus 18 in comparison with a case where the entire thickness of the cap surface 42 of the cap member 29 is uniformly formed to be large as shown in FIG. 5(*b*).

In this manner, in the lamp apparatus 18 of this embodiment, with the provision of the light-emitting module mounting portion 46 projecting from the lower surface of the cap 30, the improvement of flexibility of luminous intensity distribution control is achieved, and the increase in mass is alleviated without lowering the heat radiation performances.

In particular, by forming the light-emitting module mounting portion 46 into a frustum shape having a larger surface area on the upper surface than the lower surface, the improvement of flexibility of the luminous intensity distribution control is achieved, and the increase in mass is alleviated without lowering the heat radiation performances.

In this case, the surface area of the frustum shaped light-emitting module mounting portion 46 on the upper surface is preferably twice to four times the surface area of the lower side. When the surface area is smaller than the twice, the heat conductivity of the frustum shaped light-emitting module mounting portion 46 to the heat radiator 17 is lowered, and if the surface area is larger than four times, formation of the cap 30 having a predetermined specified dimension becomes difficult in terms of dimensions.

The position on the upper surface side of the light-emitting module mounting portion 46 (at the foot of the frustum shape) is not limited to a case of being positioned inside the peripheral portion of the lower surface of the cap surface 42, but may be positioned in the peripheral portion of the cap surface 42.

Referring now to FIGS. 6(*a*) to 6(*e*), setting of the thickness of the heat conductive sheet 22 will be described. In FIGS. 6(*a*) to 6(*e*), hatching indicating the cross section is provided only in a part of the heat conductive sheet and is omitted in other portions.

The cap member 29 of the lamp apparatus 18 and the heat radiator 17 of the luminaire 11 are molded articles of aluminum diecast or the like molded with dies, respectively, and external waviness or distortion may be generated on the surfaces thereof.

For example, FIG. 6(*a*) shows an example in which distortion such as a hollow of the outer surface is generated on the cap surface 42 of the cap member 29 and on the connecting surface 94 of the heat radiator 17 respectively. In this case, since the cap surface 42 of the cap member 29 and the connecting surface 94 of the heat radiator 17 do not become flat, even when the cap surface 42 of the cap member 29 and the connecting surface 94 of the heat radiator 17 come into contact with each other, there remains a space S therebetween. In this state, effective heat conductivity from the cap member 29 to the heat radiator 17 cannot be obtained.

Therefore, as shown in FIG. 6(*e*), the heat conductive sheet 22 is interposed between the cap surface 42 of the cap member 29 and the connecting surface 94 of the heat radiator 17, whereby high heat conductivity from the cap member 29 to the heat radiator 17 is ensured.

A thickness T of the heat conductive sheet 22 is preferably from 1 to three times a maximum space dimension of the space S which may be generated between the cap surface 42 of the cap member 29 and the connecting surface 94 of the heat radiator 17. More preferable range is a range from 1.5 to 2 times.

If the thickness T of the heat conductive sheet 22 is equal to the space S, and is at least equal to the maximum space dimension of the space S, the space S may be filled with the heat conductive sheet 22 and hence favorable heat conduction from the cap member 29 to the heat radiator 17 via the heat conductive sheet 22 is achieved. Also, if the thickness T of the heat conductive sheet 22 is larger than three times the maximum space dimension of the space S, since the lamp apparatus 18 is rotated with the heat conductive sheet 22 pressed against the heat radiator 17 at the time of mounting the lamp, there may arise damage such that an intermediate portion of the heat conductive sheet 22 in the thickness direction is twisted and broken and hence the heat conductivity from the cap member 29 to the heat radiator 17 may easily be impaired. Depending on the material, the heat conductivity is lowered by an amount corresponding to the increase in thickness. Therefore, the thickness T of the heat conductive sheet 22 is preferably set to a range from 1 to 3 times the maximum space dimension of the space S.

If the thickness T of the heat conductive sheet 22 is at least 1.5 times the maximum space dimension of the space S, the heat conductive sheet 22 is compressed between the cap member 29 and the heat radiator 17, and the heat conductive sheet 22 comes into press contact with the cap member 29 and the heat radiator 17, respectively, the high heat conductivity from the cap member 29 to the heat radiator 17 via the heat conductive sheet 22 is obtained. If the thickness T of the heat conductive sheet 22 is two times or smaller than the maximum space dimension of the space S, it is preferable in terms of damage prevention of the heat conductive sheet 22 at the time of mounting the lamp or the improvement of the heat conductivity. Therefore, a further preferable range of the thickness T of the heat conductive sheet 22 is preferably set to a range from 1.5 to 2 times the maximum space dimension of the space S.

Also, specifically, a plane corresponding to the cap surface 42 of the cap member 29 and the connecting surface 94 of the heat radiator 17, when being flat surfaces is assumed to be an imaginary plane P. The thickness T of the heat conductive sheet 22 is defined to be in a range not smaller than a maximum space dimension t which is an addition of a maximum space dimension t2 on the side of the cap surface 42 of the cap member 29 with respect to the imaginary plane P, and a maximum space dimension t1 on the side of the contact surface 84 of the heat radiator 17 with respect to the imaginary plane P, and not larger than 0.5 mm.

If the thickness T of the heat conductive sheet 22 is larger than 0.5 mm, as described above, the damage of the heat conductive sheet 22 at the time of mounting the lamp or lowering of the heat conductivity occur easily. Therefore, a range from the maximum space dimension t inclusive to 0.5 mm inclusive is preferable.

More specifically, the thickness of the heat conductive sheet 22 is preferably a range from 0.1 to 0.5 mm.

If the thickness of the heat conductive sheet 22 is smaller than 0.1 mm, the thickness is insufficient for filling the space S or a margin of compression of the heat conductive sheet 22 when the heat conductive sheet 22 is clamped between the cap member 29 and the heat radiator 17 is small, so that the heat conductive sheet 22 can hardly be brought into press contact with the cap member 29 and the heat radiator 17 respectively, and handling properties of the heat conductive sheet 22 is lowered. Also, if the thickness T of the heat conductive sheet 22 is larger than 0.5 mm, as described above, the damage of the heat conductive sheet 22 at the time of mounting the lamp or the lowering of the heat conductivity occur easily. Therefore, the thickness T of the heat conductive sheet 22 is preferably a range from 0.1 to 0.5 mm.

From these reasons, an example of the thickness of the heat conductive sheet 22 is on the order of 0.27 mm and, in this case, the thickness of the silicone sheet 22*a* is 0.2 mm, and the thickness of the metal foil 22*b* is 0.07 mm.

In this manner, in the lamp apparatus 18 of this embodiment, even when external waviness or distortion is generated on the surfaces of the cap member 29 of the lamp apparatus 18 and the heat radiator 17 of the luminaire 11 because of being molded by the die and hence the space S is generated therebetween with the cap member 29 and the heat radiator 17 pressed against each other, high heat conductivity from the cap member 29 to the heat radiator 17 is ensured by using the heat conductive sheet 22.

Therefore, in order to flatten the cap surface 42 of the cap member 29 and the connecting surface 94 of the heat radiator 17, what is necessary is just to use the heat conductive sheet 22 without a necessity of performing a cutting work and a grinding work, so that the production cost may be reduced and the productivity may be improved.

In addition, since the thickness T of the heat conductive sheet 22 is set in a range from 1 to three times the maximum space dimension t of the space S which may be generated between the cap surface 42 of the cap member 29 and the connecting surface 94 of the heat radiator 17, stable heat conductivity from the lamp apparatus 18 to the luminaire 11 is ensured.

In particular, if the thickness T of the heat conductive sheet 22 is set in a range from 1.5 to twice the maximum space dimension t of the space S, further stable heat conductivity from the lamp apparatus 18 to the luminaire 11 is ensured.

Also, by setting the thickness T of the heat conductive sheet 22 to be in a range not smaller than the maximum space dimension t which is an addition of the maximum space dimension t2 on the side of the cap surface 42 of the cap member 29 with respect to the imaginary plane P when the cap surface 42 of the cap member 29 and the connecting surface 94 of the heat radiator 17 are flat surfaces and the maximum space dimension t1 on the side of the contact surface 84 of the heat radiator 17, and not larger than 0.5 mm, stable conductivity from the lamp apparatus 18 to the luminaire 11 via the heat conductive sheet 22 is ensured.

Also, by setting the thickness of the heat conductive sheet 22 in a range from 0.1 to 0.5 mm, stable heat conductivity from the lamp apparatus 18 to the luminaire 11 via the heat conductive sheet 22 is ensured.

Furthermore, since the metal foil 22*b* is provided on the surface of the heat conductive sheet 22, the heat conductive sheet 22 can slip and move easily with respect to the connecting surface 94 of the heat radiator 17 in comparison with a case where the silicone sheet 22*a* is directly in contact with the connecting surface 94 of the heat radiator 17, so that the rotational operation of the lamp apparatus 18 is facilitated. In addition, the heat conductive sheet 22 is prevented from being separated from the cap member 29 by a frictional force with respect to the connecting surface 94 of the heat radiator 17 at the time of rotational operation of the lamp apparatus 18.

Also, since the surface area or the width of the heat conductive sheet 22 is set to be wider than the surface area or the width of the light-emitting module mounting portion 46 on the upper side, heat conducted to the peripheral portion of the light-emitting module mounting portion 46 can be efficiently conducted to the heat radiator 17.

Figure 9:
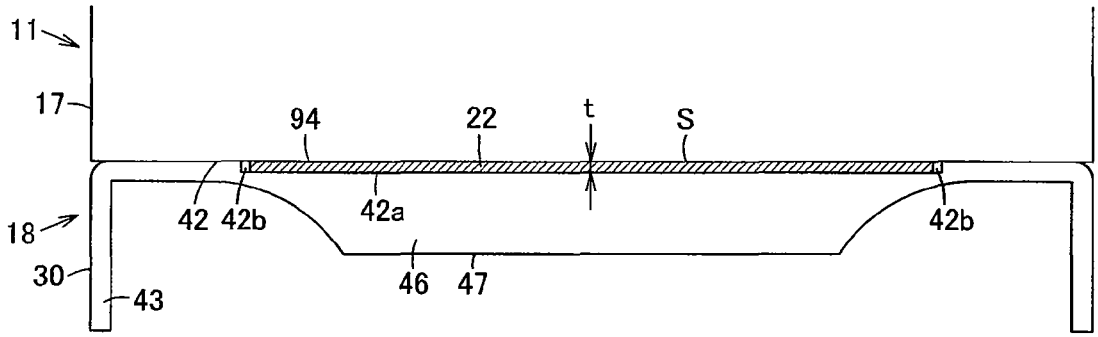
FIG. 9 is a cross-sectional view of parts of a lamp apparatus and a luminaire according to a second embodiment.

Referring now to FIG. 9, a second embodiment will be described. The same configurations as those in the first embodiment are designated by the same reference numerals and description will be omitted. In FIG. 9, hatching indicating the cross section is provided only in a part of the heat conductive sheet and is omitted in other portions. A depression 42*a* configured to accommodate part of the heat conductive sheet 22 in the thickness direction is formed on the cap surface 42 of the lamp apparatus 18.

In this case, the maximum space dimension t of the space S which may be generated between the cap surface 42 of the cap member 29 and the connecting surface 94 of the heat radiator 17 is a dimension including a depth of the depression 42*a*. Therefore, the thickness T of the heat conductive sheet 22 is preferably in a range from 1 to three times the maximum space dimension including the depth of the depression 42*a* and the space S which may be generated between the cap surface 42 of the cap member 29 and the connecting surface 94 of the heat radiator 17. Accordingly, stable heat conductivity from the lamp apparatus 18 to the luminaire 11 is ensured.

Also, the shape of a peripheral portion of the depression 42*a* is larger than the outline of the heat conductive sheet 22, and a space portion 42*b* is formed between the peripheral portion of the depression 42*a* and the peripheral portion of the heat conductive sheet 22 in a state in which the heat conductive sheet 22 is arranged in the depression 42*a*. The space portion 42*b* allows protrusion of the heat conductive sheet 22 clamped between the cap surface 42 of the cap member 29 and the connecting surface 94 of the heat radiator 17 toward the periphery when the lamp apparatus 18 is mounted on the luminaire 11, and allows compression of the heat conductive sheet 22 between the cap surface 42 of the cap member 29 and the connecting surface 94 of the heat radiator 17.

Accordingly, substantial impairment of heat conductivity due to protrusion of the heat conductive sheet 22 from the depression 42*a* or swelling of part of the heat conductive sheet 22 due to an abutment thereof against a side wall of the depression 42*a* may be prevented and, in addition, the heat conductive sheet 22 may be prevented from becoming damaged.

Therefore, the space portion 42*b* is formed to have a width taking the amount of swelling of the heat conductive sheet 22 toward the periphery into consideration.

It is also possible to form a depression configured to accommodate a swelled portion of the heat conductive sheet 22 due to the compression on a bottom wall of the depression 42*a* in addition to the space portion 42*b*, or instead of the space portion 42*b*.

Figure 10:
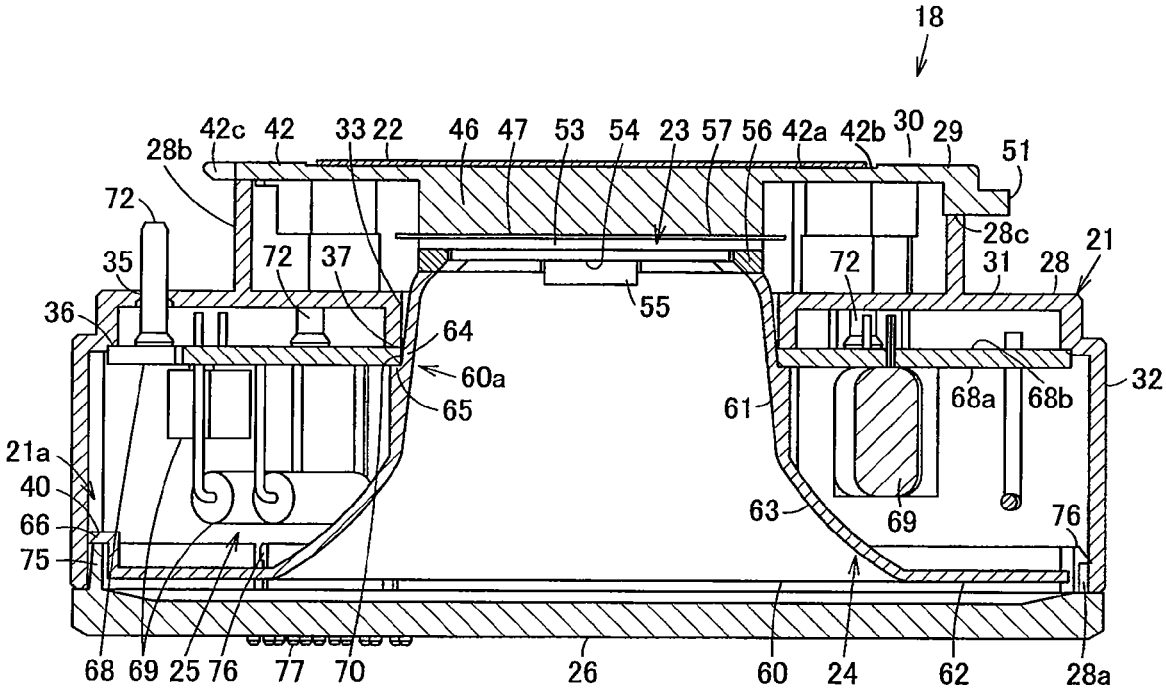
FIG. 10 is a cross-sectional view of a lamp apparatus according to a third embodiment.

FIG. 10 shows a third embodiment. The same configurations as in the above-described embodiment are designated by the same reference numerals and description is omitted.

An annular projecting portion 28*b* which constitutes a peripheral surface of the cap 30 is integrally formed from an upper surface of the flat plate portion 31 of the case 28 of the housing 21.

The cap member 29 does not have the peripheral surface portion 43, which is provided in the configuration in the first embodiment. However, the cap member 29 in this embodiment includes the cap surface 42, the light-emitting module mounting portion 46, and the plurality of keys 51.

The diameter of the cap member 29 (the cap surface 42) is larger than the diameter of the projecting portion 28*b* of the case 28, and the peripheral portion of the cap member 29 (the cap surface 42) is projecting from an outer peripheral surface of the projecting portion 28*b* of the case 28.

The shape of the light-emitting module mounting portion 46 includes one surface (upper surface) which constitutes one flat surface of an outline of the cap 30 and the other surface (lower surface) to which the light-emitting module 23 is mounted, and the surface area of the one surface is larger than the surface area of the other surface, and the outer periphery of the other surface projects vertically from the cap 30. In other words, by increasing the thickness of part of the lower surface of the cap member 29, for example, the center portion of the cap surface 42, the light-emitting module mounting portion 46 is formed integrally so as to project from the lower surface of the cap surface 42 vertically toward the opening 28*a* of the housing 21. The shape or the surface area of the mounting surface 47 on the lower surface side of the light-emitting module mounting portion 46 corresponds to the shape or the surface area of the light-emitting module 23.

The respective keys 51 are formed integrally with the cap surface 42. The projecting portion 28*b* of the case 28 is formed with a plurality of depressed grooves 28*c* in which the respective keys 51 are fitted.

Since the cap member 29 is not provided with the peripheral surface portion 43, the key grooves 50 formed on the peripheral surface portion 43 are not provided as well. However, the peripheral portion of the cap member 29 (the cap surface 42) is formed with a plurality of notches 42*c* which allow insertion of the respective keys 89 of the socket 16. The lamp apparatus 18 is configured to be mounted to the socket 16 by fitting the notches 42*c* on the keys 89 of the socket 16, and hooking the lower surface of the periphery of the cap surface 42 on the keys 89.

Therefore, the cap 30 includes the case 28 having insulating properties and provided with the projecting portion 28*b* projecting from the upper surface thereof, the lamp pins 72 projecting from the peripheral portion of the upper surface of the case 28, and the cap member 29 including the light-emitting module mounting portion 46 formed integrally therewith and arranged on an upper side of the projecting portion 28*b*.

Then, the light-emitting module mounting portion 46 of the lamp apparatus 18 is subject to only a slight amount of lowering of the heat radiating performance in comparison with the case where the light-emitting module mounting portion 46 is formed into the frustum shape, the amount of usage of the material when forming the cap member 29 may be reduced. Accordingly, reduction of costs and improvement of productivity is achieved, and the increase in mass of the cap member 29 may be further alleviated.

In this manner, in the lamp apparatus 18 of this embodiment as well, with the provision of the light-emitting module mounting portion 46 projecting from the lower surface of the cap 30, the improvement of flexibility of luminous intensity distribution control is achieved, and the increase in mass is alleviated without lowering the heat radiation performances.

In addition, by forming the light-emitting module mounting portion 46 so as to project vertically from part of the lower surface of the cap 30, the increase in the mass of the cap member 29 is further alleviated in comparison with the case where the light-emitting module mounting portion 46 is formed into the frustum shape, so that the mass of the cap member 29 can be confined not to exceed an upper limit of the mass specified for the lamp apparatus 18 easier.

By forming the peripheral surface portion of the cap 30 by the projecting portion 28*b* of the case 28 having insulating properties, electric insulating properties with respect to the lamp pins 72 may be improved even when the cap member 29 is formed of a metal. In this case, since the diameter of the cap surface 42 may be increased, heat radiating performance is not impaired. The configuration of such a cap 30 may be combined with the first and second embodiments described above.

Although the light-emitting module mounting portion 46 is formed integrally with the cap member 29, the light-emitting module mounting portion 46 may be formed separately from the cap member 29 and mounted to the cap member 29 via the heat conductive sheet or the like. In this case, the lamp apparatus 18 is subject to only a slight amount of lowering of the heat conductivity from the light-emitting module 23 to the heat radiator 17, and on that basis, the lamp apparatus 18 providing different luminous intensity distribution controls can be provided easily by using the common cap member 29, and selecting the light-emitting module mounting portion 46 having different heights depending on the luminous intensity distribution controls.

The heat conductive sheet 22 may be provided on the heat radiator 17 of the luminaire 11 instead of the cap member 29 of the lamp apparatus 18 or may be provided both on the cap member 29 and on the heat radiator 17. What is essential is that the heat conductive sheet 22 is interposed between the cap member 29 and the heat radiator 17. Accordingly, since the heat conductive sheet 22 is interposed between the cap member 29 of the lamp unit 18 mounted on the socket 16 of the luminaire 11 and the heat radiator 17 and are thermally connected therebetween, the heat of the light-emitting module 23 can be conducted efficiently to the heat radiator 17, so that the improvement of the heat radiating performance is achieved.

Figure 11:
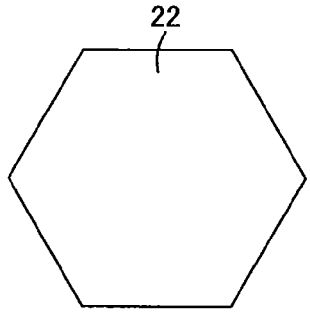
FIG. 11 is a front view of a heat conductive sheet of a lamp apparatus according to a fourth embodiment.

Also, as in a fourth embodiment shown in FIG. 11, the heat conductive sheet 22 may be formed into a hexagonal shape. Since the heat conductive sheet 22 is formed by punching out a plurality of the heat conductive sheets 22 from a large sheet material, by employing the hexagonal shape as the shape of the heat conductive sheet 22, the adjacent heat conductive sheets 22 can be punched without any space therebetween. Therefore, by employing the hexagonal shape as the shape of the heat conductive sheet 22, the number of heat conductive sheets 22 to be formed from sheet members having the same surface area may be increased, and hence the price of the heat conductive sheet 22 can be reduced in comparison with the case where a circular shape is employed as the shape of the heat conductive sheet 22.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A lamp apparatus comprising:

a light-emitting module including a light-emitting element;

a housing having a case formed of resin and opening in a direction of irradiation of a light beam emitted by the light-emitting element, and a cap disposed on a side of the case opposite from the direction of irradiation of the light beam, the case including an annular projecting portion projecting in a direction opposite from the direction of irradiation of the light beam, the cap including a cap member formed of a metal and arranged on an end face of the projecting portion, the cap member includes a light-emitting module mounting portion having a lower surface to which the light-emitting module is mounted, the cap member having an upper surface that is larger than the lower surface; and a lighting circuit accommodated in the housing.

2. The apparatus according to claim 1, wherein the cap includes lamp pins projecting from the case in the direction opposite from the direction of irradiation of the light beam.

3. The apparatus according to claim 1, wherein the upper cap surface of the cap member is thermally connected to a connecting surface of a luminaire, and the cap surface includes a heat conductive sheet having a silicone sheet adhered to the upper cap surface and a metal foil adhered to the silicone sheet.

4. The apparatus according to claim 3, wherein the thickness of the heat conductive sheet is in a range from 0.1 to 0.5 millimeters.

5. The apparatus according to claim 3, wherein the heat conductive sheet is formed into a polygonal shape.

6. The apparatus according to claim 3, wherein a surface area of the heat conductive sheet is larger than a surface area of the light emitting module mounting surface of the light-emitting module mounting portion.

7. The apparatus according to claim 3, wherein the cap surface is formed with a depression configured to accommodate part of the heat conductive sheet in a thickness direction, the depression further including a space portion between the cap surface and a peripheral portion of the heat conductive sheet.

8. A luminaire comprising:

apparatus according to claim 1;

a socket configured to mount the cap of the lamp apparatus; and a heat radiator to which the cap to be mounted on the socket is thermally connected.

9. A luminaire comprising:

a lamp apparatus according to claim 3;

a socket configured to allow the cap of the lamp apparatus to be mounted thereon by fitting and rotating the cap by a predetermined angle; and a heat radiator including the connecting surface to which the cap to be mounted on the socket is thermally connected via the heat conductive sheet.

10. A luminaire comprising:

a lamp apparatus according to claim 1;

a socket configured to allow the cap of the lamp apparatus to be mounted thereon by fitting and rotating the cap by a predetermined angle;

a heat radiator including a connecting surface to which the cap to be mounted on the socket is thermally connected;

a heat conductive sheet interposed between the connecting surface and the cap when the connecting surface and the cap are thermally connected; and a depression formed on at least one of the cap and the connecting surface, configured to accommodate part of the heat conductive sheet in a direction of the thickness, and having a space portion between a peripheral portion of the heat conductive sheet and the depression.

* * * * *